US006467877B2

(12) United States Patent
Ellson

(10) Patent No.: US 6,467,877 B2
(45) **Date of Patent: *Oct. 22, 2002**

(54) METHOD AND APPARATUS FOR HIGH RESOLUTION ACOUSTIC INK PRINTING

(75) Inventor: Richard N. Ellson, Palo Alto, CA (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/412,275

(22) Filed: Oct. 5, 1999

(65) Prior Publication Data

US 2002/0126166 A1 Sep. 12, 2002

(51) Int. Cl.[7] ..... B41J 2/135
(52) U.S. Cl. ..... 347/46
(58) Field of Search ..... 347/20, 46, 44, 347/15, 10, 11, 12, 9, 40, 55; 427/457, 565; 239/4, 102.2

(56) References Cited

U.S. PATENT DOCUMENTS

| | | | | |
|---|---|---|---|---|
| 4,386,358 A | | 5/1983 | Fischbeck | 346/1.1 |
| 4,602,852 A | | 7/1986 | Moroz | 350/358 |
| 4,748,461 A | | 5/1988 | Elrod | 346/140 R |
| 5,122,818 A | | 6/1992 | Elrod et al. | 346/140 |
| 5,191,354 A | | 3/1993 | Quate | 346/1.1 |
| 5,565,113 A | | 10/1996 | Hadimioglu et al. | 216/2 |
| 5,808,636 A | | 9/1998 | Stearns | 347/46 |
| 5,912,679 A | * | 6/1999 | Takayama et al. | 347/10 |
| 6,045,208 A | * | 4/2000 | Hirahara et al. | 347/10 |
| 6,155,671 A | * | 12/2000 | Fukumoto et al. | 347/46 |
| 6,364,454 B1 | * | 4/2002 | Hadimioglu | 347/46 |

OTHER PUBLICATIONS

Hamimioglu et al., "Acoustic Ink Printing", IEEE 1992. Ultrasonics Symposium (Cat. No. 92CH3118–7), NY, NY, 1992, p. 929–35, vol. 2.
Imaino et al., "Acoustic Dispersion and Attenuation in Toners", Photographic Science and Engineering, vol. 28, No. 6, Nov./Dec. 1984.

* cited by examiner

*Primary Examiner*—John Barlow
*Assistant Examiner*—K. Feggins
(74) *Attorney, Agent, or Firm*—Fay, Sharpe, Fagan, Minnich & McKee, LLP

(57) ABSTRACT

A printhead for an acoustic ink printer includes at least one acoustic generator for producing acoustic sound waves. The printhead also includes at least one lens. Each lens corresponds to one of the acoustic generators. A fluid is positioned over the at least one lens. A cover is positioned over the fluid. The cover includes at least one aperture. Each of the apertures corresponds to one of the lenses. An edge portion of each aperture contacts the fluid, thereby forming a corresponding meniscus in the fluid. Each lens focuses the acoustic sound waves produced by the respective acoustic generator to an ejection point on the corresponding meniscus. A droplet of the fluid is ejected from each of the ejection points. Directions of each of the acoustic sound waves are at respective oblique angles with respect to the corresponding meniscus. A direction at which each droplet is ejected from each ejection point is a function of a duration of the acoustic sound wave generated by the acoustic generator.

20 Claims, 2 Drawing Sheets

METHOD AND APPARATUS FOR HIGH RESOLUTION ACOUSTIC INK PRINTING

This is a continuation of application Ser. No. 09/412,275, filed Oct. 5, 1999.

BACKGROUND OF THE INVENTION

The present invention relates to acoustic ink printing. It finds particular application in conjunction with producing higher pixel resolutions from an acoustic ink printhead and will be described with particular reference thereto. It will be appreciated, however, that the invention will also find application in correcting directionality errors for droplets produced by acoustic ink printers, and the like.

Various fluid application technologies, such as printing technologies, are being developed. One such technology uses focused acoustic energy to eject droplets of marking material from a printhead onto a recording medium.

Acoustic ink printheads typically include a plurality of droplet ejectors, each of which launches a converging acoustic beam into a pool of fluid (e.g., liquid ink). The angular convergence of this beam is selected so that the beam focuses at or near the free surface of the ink (i.e., at the liquid-air interface). Printing is performed by modulating the radiation pressure that the beam of each ejector exerts against the free surface of ink to selectively eject droplets of ink from the free surface.

FIG. 1 illustrates a schematic of a conventional ejector of a printhead 10 for use in an acoustic ink printer. A transducer 12 and a lens 14 are disposed on opposite sides of a wafer 16. The wafer 16 is preferably formed of a glass. A thin metal plate 18 is spaced vertically from the wafer 16. The metal plate 18 defines an aperture 22. The aperture 22 is disposed adjacent the lens 14 and the transducer 12. A fluid 24, preferably selected from a group including water and aqueous inks, is disposed between the metal plate 18 and the wafer 16. An air space is disposed on the side of the metal plate 18 opposite the fluid 24. An air-fluid interface 26 is disposed at the aperture 22 of the metal plate 18. The fluid 24 wets the edges of the aperture 22. The air-fluid interface 26 is curved (e.g., crescent-shaped) and is commonly referred to as a meniscus.

In the operation of the ejector, the transducer 12 generates an acoustic wave, which propagates through the fluid 24. Dotted lines in FIG. 1 indicate the boundaries of the acoustic wave. The direction in which the acoustic wave propagates is indicated by the arrows 28, 32. The lens 14 focuses the acoustic wave to a spot 34 on the meniscus 26. A droplet 36 is ejected from the aperture 22. The aperture 22 surrounds a region of the droplet formation and helps to constrain the location of the fluid surface. Ideally, as shown in FIG. 1, the droplet 36 is ejected in the direction indicated by arrow 38.

Conventional methods for ejecting a droplet from the meniscus have primarily been directed to insuring the consistent directionality of the ejected droplet. More specifically, it has typically been desirable to eject the droplet along the line defined by the propagating acoustic wave. The propagation direction is illustrated as line 38 in FIG. 1.

A first method for ejecting a droplet along the propagation direction focuses the acoustic wave to a spot on the meniscus that has a tangential plane perpendicular to the propagation direction (see spot 34 in FIG. 1). If acoustic waves of an arbitrary shape are generated, focusing the acoustic wave to such a spot is critical for producing droplets which eject in the propagation direction.

A second method for ejecting a droplet along the propagation direction is disclosed in U.S. Pat. No. 5,808,636 ("the '636 patent"), which is incorporated herein by reference. The '636 patent discloses that an ideally shaped acoustic wave produces a droplet that is ejected in the desired direction, regardless of the angle between the acoustic wave and the meniscus. The ideally shaped acoustic wave disclosed in the '636 patent is about 2 $\mu$s.

While the conventional methods for ejecting droplets from the printhead achieve a desired directionality, they also result in at least one drawback. More specifically, because the conventional methods of ejecting droplets from the printhead strive to project the droplets in a single direction, the resolution of the printed output is limited by the spacing of apertures in the printhead.

The present invention provides a new and improved apparatus and method which overcomes the above-referenced problems and others.

SUMMARY OF THE INVENTION

An apparatus ejects a droplet of a fluid from a surface of the fluid. An acoustic wave is generated to eject the droplet from an ejection spot on the surface of the fluid. A propagation direction of the acoustic wave is not perpendicular to a plane tangent to the ejection spot. The acoustic wave is shaped into a plurality of tonebursts. An ejection direction of the droplet is a function of the shape of the toneburst.

In accordance with one aspect of the invention, the fluid includes an aqueous ink.

In accordance with another aspect of the invention, a first toneburst causes a first droplet of the fluid to be ejected from the surface in a first ejection direction. The first ejection direction is substantially along the propagation direction of the acoustic wave and is independent of disturbances to the surface of the fluid caused by capillary waves generated by high-speed printing.

In accordance with a more limited aspect of the invention, a second toneburst, having a shape different from the first toneburst, causes a second droplet of the fluid to be ejected from the surface in a second ejection direction. A third toneburst, having a shape different from the first and second tonebursts, causes a third droplet of the fluid to be ejected from the surface in a third ejection direction.

In accordance with another aspect of the invention, the fluid is ejected from an ejector of a printhead of a printer.

In accordance with another aspect of the invention, the fluid is ejected from an ejector of a printhead during high-speed printing.

In accordance with another aspect of the invention, the means for generating the acoustic sound wave includes a piezo-electric element.

In accordance with a more limited aspect of the invention, the acoustic wave is shaped by a Fresnel lens.

One advantage of the present invention is that the resolution of an acoustic ink printhead is increased.

Another advantage of the present invention is that the directionality of droplets ejected from an acoustic ink printhead is controlled by the shape of the acoustic sound wave.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENT

Figure 1:
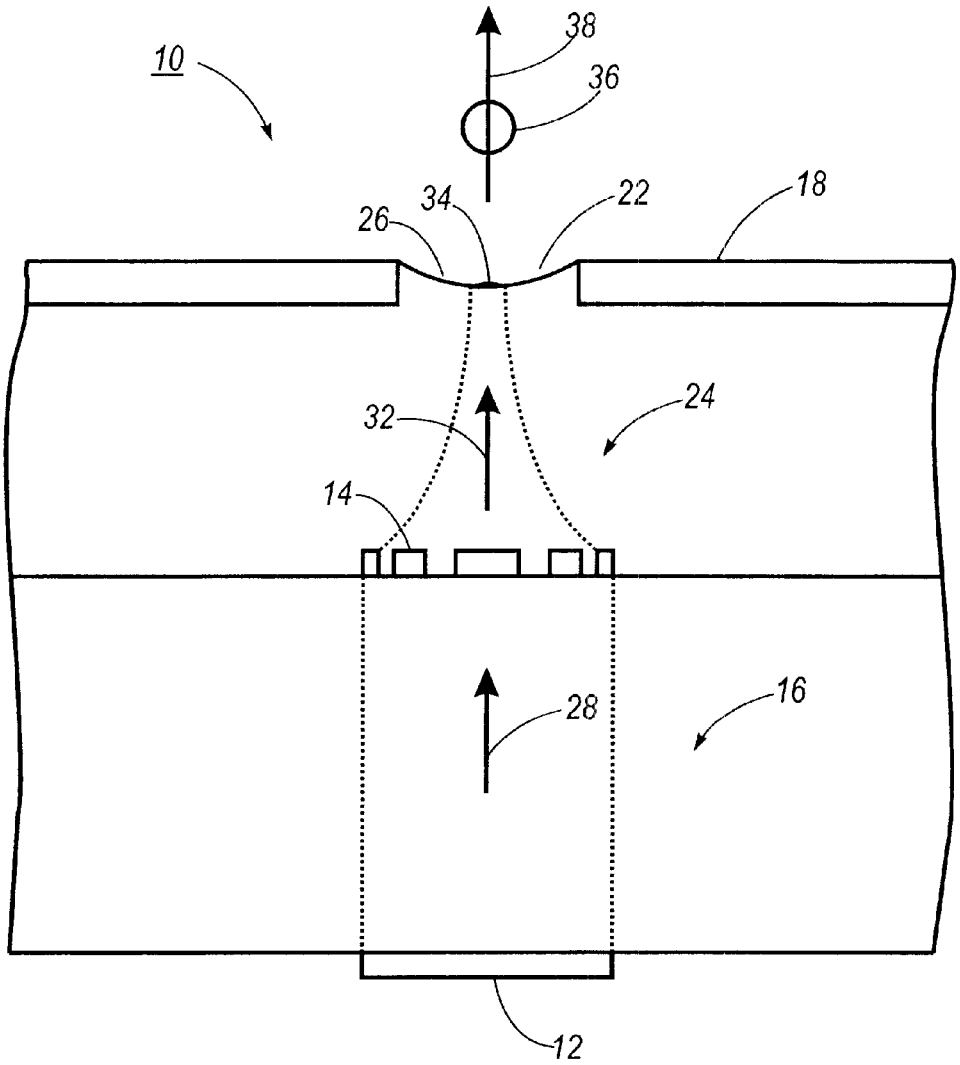
FIG. 1 (Prior Art)
FIG. 1 illustrates a partial schematic of an ejector in a conventional printhead.
Figure 2:
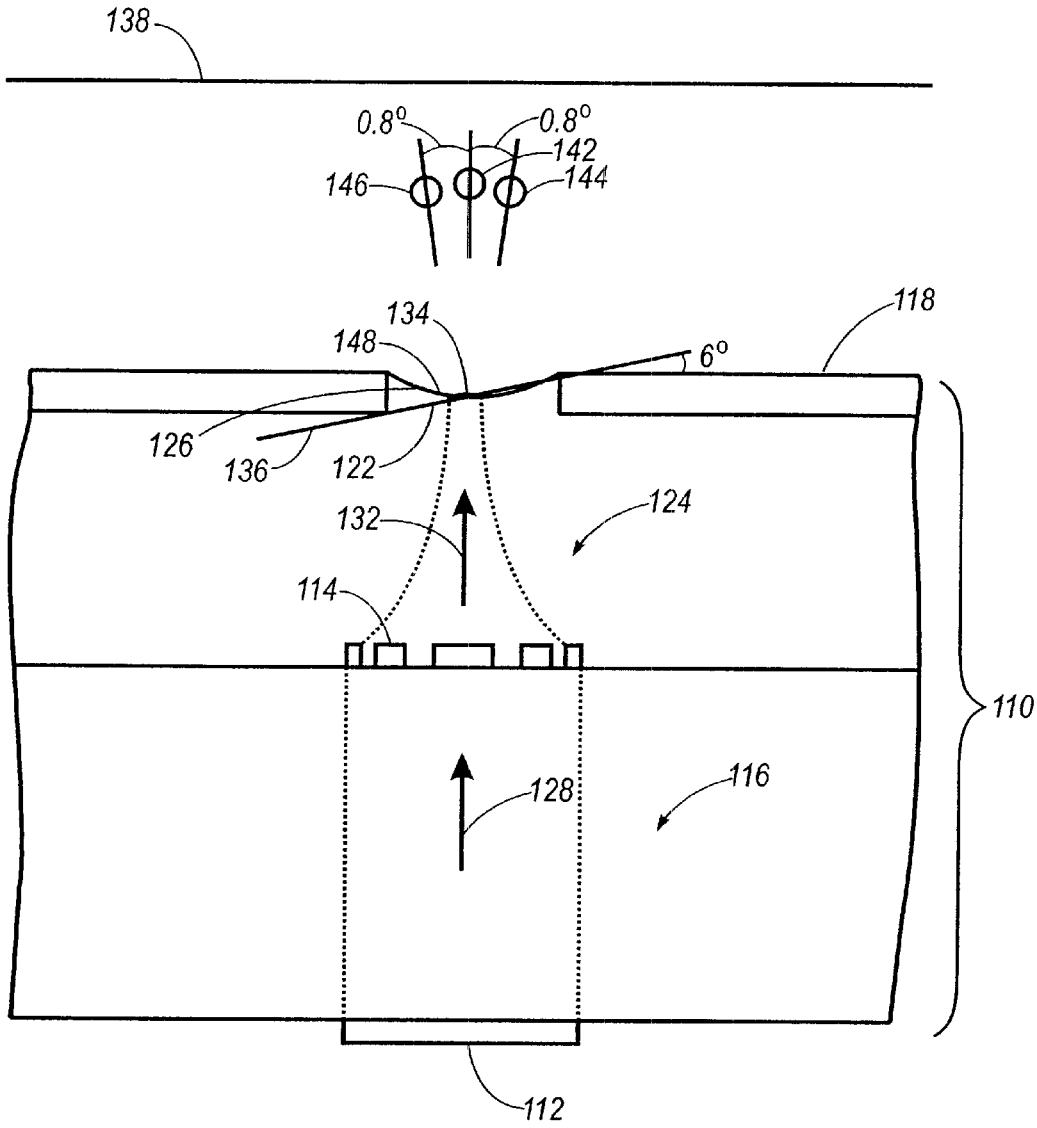
FIG. 2 illustrates a partial schematic of an ejector in a printhead according to the present invention.

FIG. 2 illustrates a schematic of a printhead 110 according to the present invention. Like the conventional printhead 10 illustrated in FIG. 1, the printhead 110 shown in FIG. 2 includes a transducer 112 and a lens 114 (e.g., a Fresnel lens) disposed on opposite sides of a wafer 116. The transducer 112 preferably includes a piezo-electric element and the wafer 116 is preferably formed of a glass. A cover 118 is spaced vertically from, and substantially parallel to, the wafer 116. Preferably, the cover 118 includes a thin metal plate. However, it is to be understood that the cover may include other materials. The cover 118 defines an aperture 122, which is also referred to as an ejector. The ejector 122 is disposed adjacent the lens 114 and the transducer 112. A fluid 124 is disposed between the cover 118 and the wafer 116. Preferably, the fluid 124 includes at least one aqueous ink. However, it is to be understood that other fluids are also contemplated. An air space is disposed on the side of the cover 118 opposite the fluid 124. Consequently, an air-fluid interface 126 is disposed at the ejector 122 of the cover 118. As in FIG. 1, the fluid 124 forms a meniscus at the air-fluid interface 126.

The transducer 112 is located substantially below the lens 114. Therefore, an acoustic wave generated by the transducer 112, which propagates along a first line 128, is received by the lens 114. After the lens 114 focuses the acoustic wave, the wave continues propagating along a second line 132. The acoustic wave meets the air-fluid interface 126 near the focal spot 134, where a droplet is ejected. A plane 136 that is tangent to the spot at the center of the focal spot 134 is not perpendicular to the direction in which the acoustic wave propagates.

It is to be understood that FIGS. 1 and 2 show only partial views of the printheads 10, 110. More specifically, the full printheads 10, 110 preferably include a plurality of ejectors.

The printhead 110 is preferably about 1.0 mm from a receiving medium 138 (e.g., paper). During use, which may include high-speed printing, the printhead 110 is moved with respect to the paper 138 while the fluid 124 (e.g., aqueous ink) is ejected from the apertures 122.

To increase the pixel resolution of the fluid on the paper, multiple droplets are ejected from each aperture in varying directions. For example, if one (1) droplet is ejected from each aperture to produce a resolution of about 600 dots per inch ("dpi") on the receiving medium, three (3) droplets are ejected from each aperture to produce a resolution of about 1,800 dpi; similarly four (4) droplets are ejected from each aperture to produce a resolution of about 2,400 dpi. As discussed above, the lens 114 is misaligned with the meniscus 126 (i.e., the tangent plane 136 to the spot 134 where the acoustic sound wave intersects the meniscus 126 is not perpendicular to the direction in which the acoustic wave propagates). Therefore, the directionality of each droplet is controlled by altering the shape of the toneburst, or more specifically, the duration (i.e., width) of the acoustic sound wave generated by the transducer 112. As discussed above, the '636 patent discloses that an ideally shaped acoustic wave produces a droplet that is ejected in the propagation direction of the acoustic wave, regardless of the angle between the acoustic wave and the meniscus. When the propagation direction of the acoustic sound wave is not perpendicular to the meniscus 126 (e.g., when the lens 114 is misaligned with the meniscus 126), a direction in which a droplet is ejected from the meniscus 126 is a function of the angle between the propagation direction of the acoustic sound wave and the tangent plane 136 to the meniscus 126.

More specifically, a pulse width of about 2 $\mu$s causes the first droplet to be ejected from the focal spot 134 of the meniscus 126 in approximately the same direction in which the acoustic sound wave propagates through the fluid (i.e., in the direction defined by the lines 128, 132). The direction in which the first droplet is ejected is independent of disturbances to the fluid surface caused by capillary waves that are generated by high-speed printing. For a water-like ink at room temperature, with a beam-to-meniscus tilt of about 6 degrees (see FIG. 2), a change of about 1 $\mu$s in the pulse width results in about a 1.5 degree deflection of the droplet from the propagation direction of the acoustic sound wave. In other words, pulse widths of about 1 $\mu$s and about 3 $\mu$s will produce droplets which are deflected about 1.5 degrees on respective sides of the propagation direction. This relationship between pulse width and droplet direction is approximately a linear function.

Pixels printed at about 600 dots per inch dpi on paper are spaced about 42 $\mu$m away from one another. Similarly, pixels printed at about 1,800 dpi are spaced about 14 $\mu$m away from one another. The following equation defines the relationship between the angular deflection necessary for printing droplets a specified distance from one another:

$$\phi=\tan^{-1}(a/b)$$

where: $\phi$=the deflection angle away from the propagation direction of the acoustic wave;

a=the desired distance between the droplets on the recording medium; and b=the distance between the printhead and the recording medium.

Therefore, the required deflection angle to achieve droplets 14 $\mu$m apart from one another (i.e., 1,800 dpi) on a receiving medium 1.0 mm (i.e., 1,000 $\mu$m) away from the printhead is:

$$\phi=\tan^{-1}(14/1{,}000)=0.8 \text{ degrees.}$$

In other words, to achieve a 1,800 dpi resolution (i.e., produce droplets 14 $\mu$m away from each other) on a receiving medium about 1.0 mm away, each ejector in the printhead produces three (3) droplets. A first droplet 142 is ejected along the direction in which the acoustic sound wave propagates. Two (2) additional droplets 144, 146 are ejected on either side of the first droplet 142, in a direction about 0.8 degrees away from the propagation direction (see FIG. 2). Based on the linear relationship between pulse width and droplet direction, which is discussed above, the three (3) pulse widths necessary to produce the three (3) droplets 142, 144, 146, which have a distance of about 14 $\mu$m between each other, are about 2.0 $\mu$s, about 1.5 $\mu$s, and about 2.5 $\mu$s, respectively.

Under ideal conditions, the meniscus 126 is formed symmetrically within the ejector 122. In other words, a plane which is tangent to the center of the meniscus is substantially parallel to the cover 118. In the preferred embodiment, the lens 114 is misaligned with the central spot 148 on the meniscus 126 by slightly moving the cover 118 in a horizontal direction with respect to the lens 114. In one alternate embodiment, a plate is constructed with a material deposited on one portion of each ejector. The deposited material causes the meniscus to be pushed off-center with respect to the ejector. In another alternate embodiment, the same effect is achieved by varying the wettability of the ejector surfaces from one side to the other. Regardless of which approach is implemented, the result is that the meniscus is altered so that the acoustic sound wave intersects the meniscus at a spot having a tangent plane which is not perpendicular to the propagation direction of the acoustic sound wave.

The preferred embodiment has been described with respect to increasing a pixel resolution by a multiple of three (3) (i.e., from 600 dpi to 1,800 dpi). Increasing a pixel resolution by a multiple of four (4) (i.e., from 600 dpi to 2,400 dpi) has also been discussed. However, it is to be understood that other embodiments, which increase the resolution of an acoustic ink printhead by other multiples, are also contemplated.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. An apparatus for ejecting droplets of a fluid from a surface of the fluid, comprising:

means for generating acoustic waves, in a propagation direction other than perpendicular to a tangent plane of an ejection spot on a surface of a fluid; and means for shaping the acoustic waves into a plurality of respective differently shaped tonebursts, ejection directions of respective droplets being a function of the shape of the respective toneburst.

2. The apparatus for ejecting droplets of a fluid from a surface of the fluid as set forth in claim 1, wherein the fluid includes an aqueous ink.

3. The apparatus for ejecting droplets of a fluid from a surface of the fluid as set forth in claim 1, wherein first, second, third, and fourth tonebursts, having first, second, third, and fourth shapes, respectively, cause first, second, third, and fourth droplets of the fluid to be ejected from the surface in respective ejection directions.

4. The apparatus for ejecting droplets of a fluid from a surface of the fluid as set forth in claim 3, wherein the ejection directions are distributed around the propagation direction.

5. The apparatus for ejecting droplets of a fluid from a surface of the fluid as set forth in claim 3, wherein the fluid is ejected for producing about a 2,400 dot per inch image.

6. The apparatus for ejecting droplets of a fluid from a surface of the fluid as set forth in claim 1, wherein the fluid is ejected from an ejector of a printhead during high-speed printing.

7. The apparatus for ejecting droplets of a fluid from a surface of the fluid as set forth in claim 1, wherein the means for generating includes a piezo-electric element.

8. The apparatus for ejecting droplets of a fluid from a surface of the fluid as set forth in claim 7, wherein the means for shaping the acoustic wave includes a Fresnel lens.

9. A printhead for an acoustic ink printer, comprising;

a substrate;

at least one acoustic generator, on a surface of the substrate, for producing acoustic sound waves;

at least one lens, each lens corresponding to one of the acoustic generators;

a fluid over the at least one lens; and a cover over the fluid, the cover defining at least one aperture, each of the at least one apertures corresponding to one of the lenses, an edge portion of each of the apertures contacting the fluid, thereby forming a corresponding meniscus in the fluid, each aperture operative to position or shape the meniscus in an off centered manner with respect to each lens, each lens focusing the acoustic sound waves produced by the respective acoustic generator to a point on the corresponding meniscus having a tangent that is not perpendicular to a propagation direction of the acoustic sound waves, a droplet of the fluid being ejected from the point, whereby directions of each of the acoustic sound waves being at respective angles with respect to the corresponding meniscus, a direction at which the droplet is ejected from the aperture are a function of a duration of the acoustic sound wave generated by the acoustic generator;

the three droplets, which are ejected from one of the apertures, are projected onto a receiving medium located about 1 mm from the covers and the three droplets are spaced about 1/1,800" apart from one another after being projected onto the receiving medium.

10. The printhead for an acoustic ink printer as set forth in claim 9, wherein:

a first acoustic sound wave having a first duration causes a first droplet to be ejected in a first direction;

a second acoustic sound wave having a second duration causes a second droplet to be ejected in a second direction; and a third acoustic sound wave having a third duration causes a third droplet to be ejected in a third direction.

11. The printhead for an acoustic ink printer as set forth in claim 10, wherein:

the first direction is substantially along a propagation direction of the acoustic sound wave;

the second direction is at a first angle relative to the propagation direction of the acoustic sound wave; and the third direction is at a second angle relative to the propagation direction of the acoustic sound wave.

12. The printhead for an acoustic ink printer as set forth in claim 11, wherein the first angle and the second angle are on respective sides of the first direction.

13. The printhead for an acoustic ink printer as set forth in claim 12, wherein:

the three droplets, which are ejected from one of the apertures, are projected onto a receiving medium located about 1 mm from the cover; and the three droplets are spaced about 1/1,800" apart from one another after being projected onto the receiving medium.

14. The printhead for an acoustic ink printer as set forth in claim 13, wherein:

the first duration is about 2 $\mu$s;

the second duration is about 1.5 $\mu$s; and the third duration is about 2.5 $\mu$s.

15. The printhead for an acoustic ink printer as set forth in claim 9, wherein the fluid includes an aqueous ink.

16. A method of ejecting droplets of a fluid from an ejection point located on a surface of the fluid, comprising:

generating acoustic waves in the fluid, at least one of the acoustic waves propagating through the fluid and intersecting the ejection point at a predetermined non-perpendicular angle to a tangent plane defined on the surface at the ejection point; and producing a toneburst of predetermined shape to select an ejection direction of the respective droplet based on a predetermined function relating the shape of the toneburst to the ejection direction.

17. The method of ejecting a droplet of a fluid as set fourth in claim 16, wherein the generating and shaping steps are performed for four droplets for producing an output having about 2,400 dots per inch.

18. The method of ejecting droplets of a fluid as set forth in claim 16, wherein the shaping step includes:

shaping a first toneburst for ejecting the droplet in a propagation direction of the toneburst;

shaping a second toneburst for ejecting a first subsequent droplet about 0.8 degrees to a first side of the propagation direction; and shaping a third toneburst for ejecting a second subsequent droplet about 0.8 degrees to a second side of the propagation direction.

19. The method of ejecting a droplet of a fluid as set forth in claim 16, wherein the shaping step includes:

shaping a toneburst greater than or equal to about 1.5 $\mu$s and less than or equal to about 2.5 $\mu$s.

20. The method of ejecting droplets of a fluid as set forth in claim 19, wherein the fluid is elected from a group including aqueous inks, the shaping step further including:

shaping the first toneburst to about 2 $\mu$s;

shaping the second toneburst to about 1.5 $\mu$s; and shaping the third toneburst to about 2.5 $\mu$s.

* * * * *